US010629146B2

(12) United States Patent
Song et al.

(10) Patent No.: US 10,629,146 B2
(45) Date of Patent: Apr. 21, 2020

(54) LIQUID CRYSTAL DISPLAY DEVICE AND DRIVING METHOD THEREOF

(75) Inventors: Hong Sung Song, Gumi-si (KR); Woong Ki Min, Daegu-si (KR); Su Hyuk Jang, Daegu-si (KR)

(73) Assignee: LG DISPLAY CO., LTD., Seoul (KR)

( * ) Notice: Subject to any disclaimer, the term of this patent is extended or adjusted under 35 U.S.C. 154(b) by 745 days.

(21) Appl. No.: 12/153,707

(22) Filed: May 22, 2008

(65) Prior Publication Data

US 2008/0297457 A1 Dec. 4, 2008

(30) Foreign Application Priority Data

May 29, 2007 (KR) ..... P2007-052001

(51) Int. Cl.
*G09G 3/36* (2006.01)

(52) U.S. Cl.
CPC ..... *G09G 3/3648* (2013.01); *G09G 3/3614* (2013.01); *G09G 2310/061* (2013.01); *G09G 2320/0247* (2013.01); *G09G 2320/0257* (2013.01)

(58) Field of Classification Search
CPC ..... G09G 3/3614; G09G 3/3648; G09G 2310/061; G09G 2320/0247; G09G 2320/0257
USPC ..... 345/89, 95, 96, 209, 210, 99; 349/36, 37
See application file for complete search history.

(56) References Cited

U.S. PATENT DOCUMENTS

| | | | | |
|---|---|---|---|---|
| 5,200,846 | A * | 4/1993 | Hiroki et al. | 349/174 |
| 5,748,164 | A * | 5/1998 | Handschy et al. | 345/89 |
| 6,947,060 | B2 * | 9/2005 | Abe | 345/691 |
| 7,348,953 | B1 * | 3/2008 | Satake | 345/97 |
| 2004/0032385 | A1 * | 2/2004 | Park et al. | 345/95 |
| 2004/0104881 | A1 * | 6/2004 | Furuya | 345/98 |
| 2005/0122295 | A1 * | 6/2005 | Sawabe | G09G 3/3614 345/88 |

* cited by examiner

*Primary Examiner* — Stephen G Sherman
(74) *Attorney, Agent, or Firm* — Dentons US LLP

(57) ABSTRACT

A liquid crystal display (LCD) device and a driving method where the LCD device includes a data controller for interleaving one of black gray scale data and intermediate gray scale data into input digital video data to input digital video data in a specific period preceding a second one of two successive frame periods in which data voltages having the same polarity are successively supplied to liquid crystal cells. A timing signal controller generates a data timing signal and a gate timing signal, based on an input timing signal, and accelerates a frequency of the data timing signal and a frequency of the gate timing signal in the specific period. A data driving circuit is included for converting the interleaved digital video data into an analog voltage in response to the data timing signal, and supplying the analog voltage to data lines in the specific period.

3 Claims, 15 Drawing Sheets

FIG. 7

| Frame | 1 | 2 | . . . | n | n+1 | . . . | 2n | 2n+1 | . . . | 3n | 3n+1 |
|---|---|---|---|---|---|---|---|---|---|---|---|
| POL | + | + | . . . | − | − | . . . | + | + | . . . | − | − |

LIQUID CRYSTAL DISPLAY DEVICE AND DRIVING METHOD THEREOF

This application claims the benefit of the Korean Patent Application No. 10-2007-0052001, filed on May 29, 2007 which is hereby incorporated by reference for all purposes as if fully set forth herein.

BACKGROUND OF THE INVENTION

Field of the Invention

The present invention relates to display devices, and more particularly to a liquid crystal display (LCD) device, and a driving method thereof.

Discussion of the Related Art

Liquid crystal display (LCD) devices display an image by controlling the light transmittance of liquid crystal cells in accordance with a video signal. In an active matrix type LCD device as illustrated in FIG. 1, data voltages to be supplied to liquid crystal cells Clc are switched by thin film transistors (TFTs) formed in the respective liquid crystal cells Clc, for active control of data. Switching using active control provides an enhancement in the display quality when displaying a moving image. In FIG. 1, the reference character "Cst" designates a storage capacitor to maintain the data voltage charged in the associated liquid crystal cell Clc, the reference character "DL" designates a data line supplied with the data voltage, and the reference character "GL" designates a gate line supplied with a scan voltage.

The LCD display device having the above-mentioned configuration can be driven in accordance with an inversion scheme in which polarity inversion not only occurs between neighboring liquid crystal cells, but also occurs at intervals of one frame to reduce DC offset components and to reduce degradation in the liquid crystals. However, when any one of data voltages having opposite polarities is dominantly supplied for a prolonged period of time, image sticking may occur. Such image sticking is called "DC image sticking" because it occurs as each liquid crystal cell is repeatedly charged with voltages having the same polarity. An example of such repeated charging with voltages of the same polarity is the case in which data voltages are supplied to the LCD device in accordance with an interlace scheme. In accordance with the interlace scheme, data voltages are supplied to liquid crystal cells on odd horizontal lines in odd frame periods, while being supplied to liquid crystal cells on even horizontal lines in even frame periods.

FIG. 2 is a waveform diagram depicting an example in which data voltages are supplied to each liquid crystal cell Clc in accordance with the interlace scheme. In this example, it is assumed that the liquid crystal cell Clc supplied with the data voltages depicted in FIG. 2 is one of the liquid crystal cells arranged on one odd horizontal line.

Referring to FIG. 2, a positive voltage is supplied to the liquid crystal cell Clc in odd frame periods, and a negative voltage is supplied to the liquid crystal cell Clc in even frame periods. Since a data voltage having a high positive polarity level is supplied to liquid crystal cells Clc arranged on odd horizontal lines, only in odd frame periods in accordance with the interlace scheme, the positive data voltage becomes dominant during 4 frame periods, as compared to the negative voltage, as shown by the waveform in the box of FIG. 2. FIG. 3 is an image showing the experimental results of DC image sticking occurring due to interlace data. When an original image corresponding to the left image in FIG. 3 is supplied to an LCD panel for a certain period of time in accordance with the interlace scheme, the data voltage that is charged in each liquid crystal cell Clc exhibits a considerable level difference between the odd frame and the even frame, as shown in FIG. 2. As a result, when a data voltage having an intermediate gray scale value, for example, a gray scale value of 127, is supplied to all liquid crystal cells Clc of the LCD panel, after the display of an original image such as the left image in FIG. 3, the pattern of the original image is dimly displayed, as shown by the right image in FIG. 3. That is, DC image sticking occurs.

Another example of DC image sticking may be the case in which an image is moved or scrolled at a certain speed. When an image is moved or scrolled at a certain speed, voltages of the same polarity may be repeatedly accumulated in each liquid crystal cell Clc in accordance with the correlation between the size of the scrolled figure and the scroll speed (moving speed). This example is illustrated in FIG. 4. FIG. 4 is an image showing the experimental results of DC image sticking occurring when an oblique line pattern or a character pattern is moved at a certain speed.

The moving image display quality of the LCD device may be degraded not only due to DC image sticking, but also due to flicker, namely, a periodic brightness difference that is visible to the naked eye of a viewer. Therefore, it is desirable to prevent the occurrence of DC image sticking and flicker to enhance the display quality of the LCD device.

SUMMARY OF THE INVENTION

Accordingly, the present invention is directed to a liquid crystal display device and a driving method thereof that substantially obviate one or more problems due to limitations and disadvantages of the related art.

An advantage of the present invention is to provide a liquid crystal display device and a driving method thereof, which are capable of preventing direct current (DC) image sticking, thereby achieving an enhancement in display quality.

Additional advantages and features of the invention will be set forth in part in the description which follows and in part will become apparent to those having ordinary skill in the art upon examination of the following or may be learned from practice of the invention. These and other advantages of the invention may be realized and attained by the structure particularly pointed out in the written description and claims hereof as well as the appended drawings.

To achieve these and other advantages and in accordance with the purpose of the invention, as embodied and broadly described herein, a liquid crystal display device comprises: a liquid crystal display panel formed with a plurality of data lines and a plurality of gate lines, the liquid crystal display panel having a plurality of liquid crystal cells; a data controller for interleaving one of black gray scale data and intermediate gray scale data into input digital video data to input digital video data in a specific period preceding a second one of two successive frame periods, in which data voltages having the same polarity are successively supplied to the liquid crystal cells; a timing signal controller for generating a data timing signal and a gate timing signal, based on an input timing signal, and accelerating a frequency of the data timing signal and a frequency of the gate timing signal in the specific period; a data driving circuit for converting the digital video data interleaved with the black or intermediate gray scale data into an analog voltage in response to the data timing signal, and supplying the analog voltage to the data lines in the specific period; and a gate driving circuit for supplying a scan pulse to the gate lines, using a plurality of gate integrated circuits operating in response to the gate timing signal, wherein the gate timing signal comprises a plurality of gate output enable signals respectively supplied to the gate integrated circuits in an independent manner, to control respective outputs from the gate integrated circuits.

The liquid crystal display panel may be driven in a divided manner for a plurality blocks, to which scan pulses are supplied by the gate integrated circuits in an independent manner in the specific period, respectively;

The liquid crystal cells included in one of the plurality of blocks may be charged with the video data voltage supplied from the data driving circuit in the specific period, and are subsequently charged with a voltage corresponding to one of the black gray scale data and the intermediate gray scale data and having a polarity opposite to a polarity of the video data voltage.

The liquid crystal cells included in the remaining blocks may be charged with the voltage corresponding to one of the black gray scale data and the intermediate gray scale data in the specific period, and are subsequently charged with the video data voltage.

The frequency of the gate timing signal and the frequency of the data timing signal may be multiplied by a multiple of (i+1)/i ("i" is an integer of 2 or more) in the specific period, as compared to periods other than the specific period.

The gate timing signal may further comprise a gate start pulse indicating output start points of the gate integrated circuits, the gate start pulse being generated to have a narrow pulse width and a wide pulse width of duration longer than the narrow pulse width in the specific period.

The gate output enable signals may be generated to periodically have a narrow pulse width and a wide pulse width, and are supplied to the gate integrated circuits after being sequentially shifted in phase, respectively.

Each of the gate output enable signals may comprise i-pulse groups each adapted to sequentially select, from an associated one of the blocks of the liquid crystal panel, i rows to be supplied to the video data voltage, and a pause period present between successive ones of the i-pulse groups while being maintained at a low logic voltage for one horizontal period or more.

Each of the scan pulses to be supplied to the gate lines of the associated block may be generated to have a narrow pulse width without being overlapped with the remaining scan pulses, based on the narrow width of the gate start pulse.

Each of the scan pulses to be supplied to the gate lines of another block, to which the black or intermediate gray scale voltage is supplied in the pause period, may be generated to have a wide pulse width, based on the wide pulse width of the gate start pulse. i scan pulses sequentially supplied to i gate lines corresponding to the i rows may be overlapped in a predetermined period.

The data driving circuit may supply the voltage corresponding to one of the black gray scale data and the intermediate gray scale data to the data lines in synchronism with the overlapping period of the i scan pulses.

In another aspect of the present invention, a method for driving a liquid crystal display device including a liquid crystal display panel formed with a plurality of data lines and a plurality of gate lines, the liquid crystal display panel having a plurality of liquid crystal cells, comprises: interleaving one of black gray scale data and intermediate gray scale data into input digital video data to input digital video data in a specific period preceding a second one of two successive frame periods, in which data voltages having the same polarity are successively supplied to the liquid crystal cells; generating a data timing signal and a gate timing signal, based on an input timing signal, and accelerating a frequency of the data timing signal and a frequency of the gate timing signal in the specific period; converting the digital video data interleaved with the black or intermediate gray scale data into an analog voltage in response to the data timing signal, and supplying the analog voltage to the data lines in the specific period; and supplying a scan pulse to the gate lines, using a plurality of gate integrated circuits operating in response to the gate timing signal, wherein the gate timing signal comprises a plurality of gate output enable signals respectively supplied to the gate integrated circuits in an independent manner, to control respective outputs from the gate integrated circuits.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention.

In the drawings:

FIG. 7 is a view illustrating the principle for preventing the occurrence of DC image sticking in association with scroll data in accordance with the LCD device driving method according to the embodiment of the present invention;

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Hereinafter, embodiments of the present invention will be described with reference to FIGS. 5 to 15.

Figure 1:
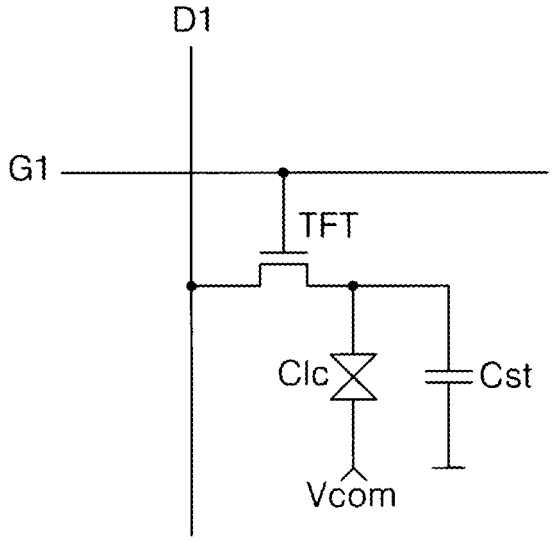
FIG. 1 Related Art
FIG. 1 is an equivalent circuit diagram illustrating one liquid crystal cell of a liquid crystal display (LCD) device.
Figure 2:
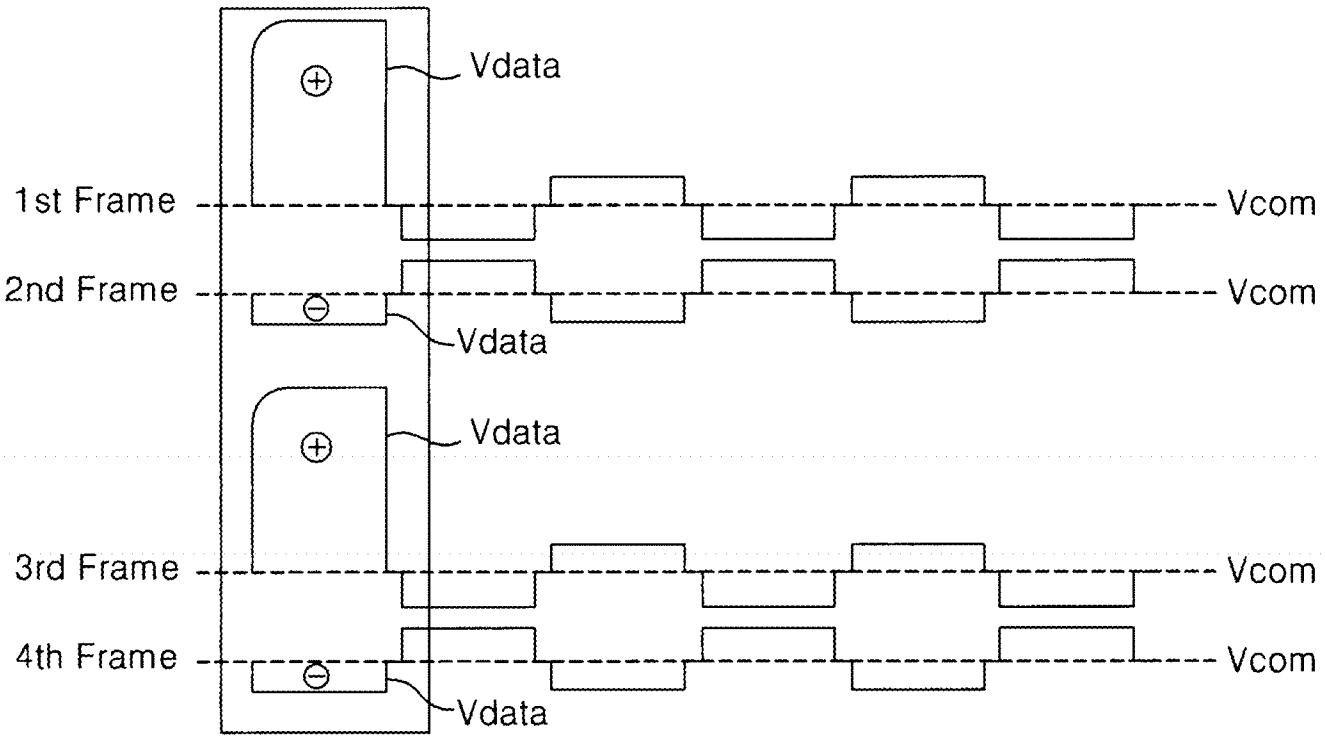
FIG. 2 Related Art
FIG. 2 is a waveform diagram of an example of interlace data.
Figure 3:
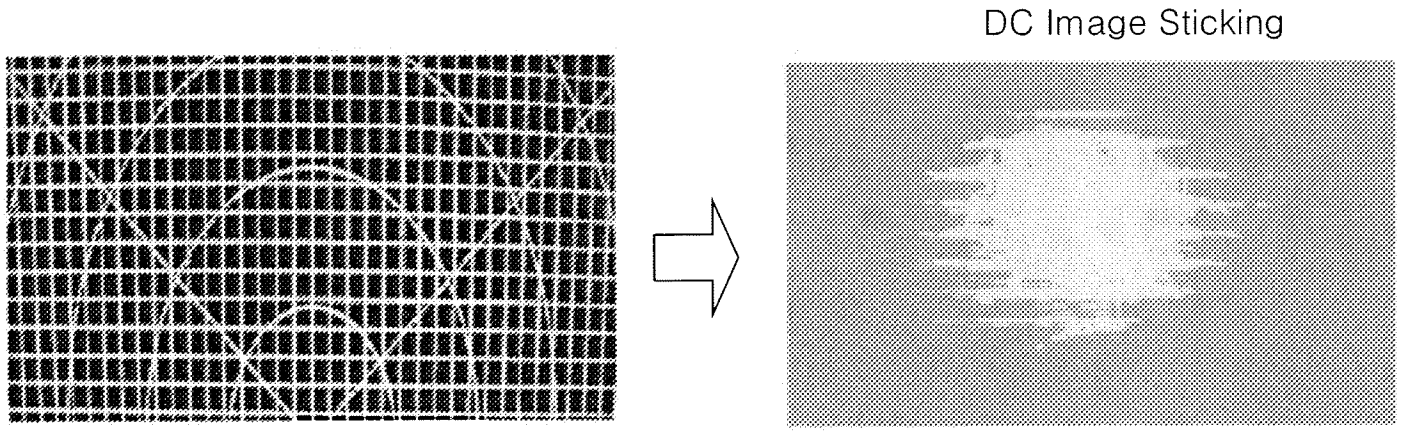
FIG. 3 is an image displayed on a screen, showing the experimental results of DC image sticking occurring due to interlace data.
Figure 4:
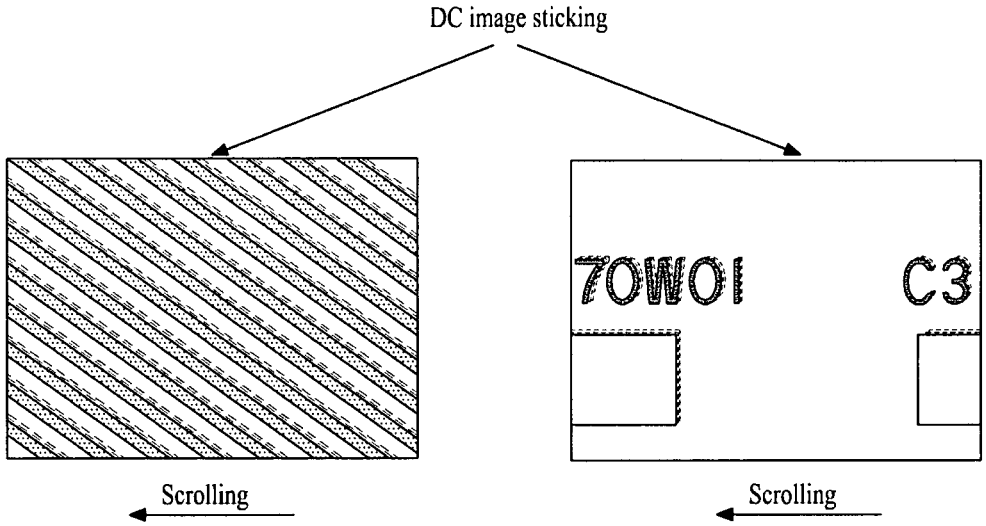
FIG. 4 Related Art
FIG. 4 is an image displayed on a screen, showing the experimental results of DC image sticking occurring due to scroll data.
Figure 5:
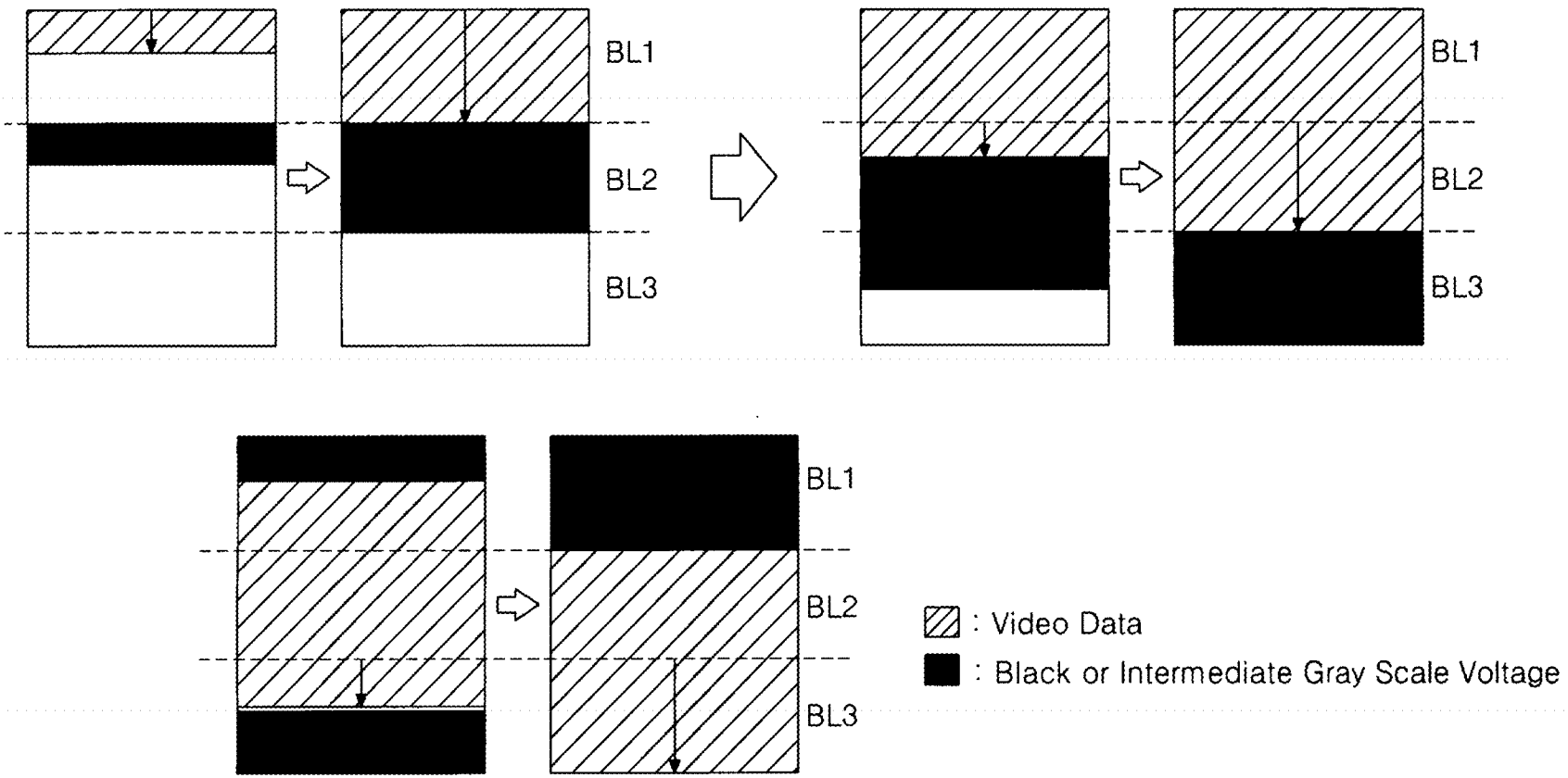
FIG. 5 is a view illustrating scan operations to charge a video data voltage and a black gray scale voltage (or an intermediate gray scale voltage) in a method for driving an LCD device in accordance with an exemplary embodiment of the present invention.
Figure 6:
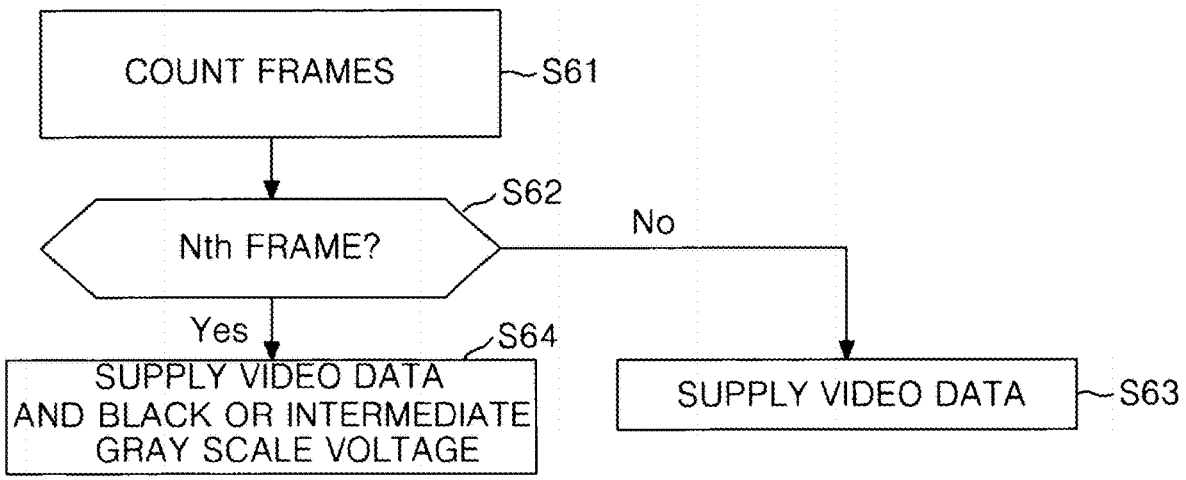
FIG. 6 is a flow chart illustrating an LCD device driving method according to the embodiment of the present invention.

Referring to FIGS. 5 and 6, in accordance with the LCD device driving method according to the illustrated embodiment of the present invention, a timing signal is counted to determine a current frame period. When the current frame period is an Nth (where "N" may be a multiple of 8 or more) frame period, the polarities of video data voltages to be supplied to liquid crystal cells are controlled to be the same as the polarities of video data voltages supplied in an (N+1)th frame period. Also, the display screen is virtually divided into a plurality of blocks. Under this condition, a normal video data voltage is sequentially supplied to the liquid crystal cells, starting from one block, and a black or intermediate gray scale voltage having a polarity opposite to the normal video data voltage is supplied to the liquid crystal cells of the remaining blocks (S61, S62, and S64).

Assuming for purposes of illustration that the display screen is virtually divided into 3 blocks, as shown in FIG. 5, in the LCD device according to the illustrated embodiment of the present invention, independent gate output enable signals GOE are supplied to three gate integrated circuits (hereinafter, referred to as "G-ICs") corresponding to the number of the blocks, respectively to independently control respective outputs of the G-ICs. In the Nth frame period, the video data voltage is sequentially supplied to the liquid crystal cells of a first block BL1, for every i rows ("i" is an integer of 2 or more). After the supply of the data voltage to the first block BL1 for every i rows, a black or intermediate gray scale voltage having an opposite polarity is simultaneously supplied to i rows of a second block BL2. After the supply of the video data voltage to all liquid crystal cells of the first block BL1 is completed, and the supply of the black or intermediate gray scale voltage to all liquid crystal cells of the second block BL2 is completed, the video data voltage is sequentially supplied to the liquid crystal cells of the second block BL2, for every rows. After the supply of the data voltage to the second block BL2 for every i rows, the opposite-polarity black or intermediate gray scale voltage is simultaneously supplied to i rows of a third block BL3. After the supply of the video data voltage to all liquid crystal cells of the second block BL2 is completed, and the supply of the black or intermediate gray scale voltage to all liquid crystal cells of the third block BL3 is completed, the video data voltage is sequentially supplied to the liquid crystal cells of the third block BL3, for every i rows. After the supply of the data voltage to the third block BL2 for every i rows, the opposite-polarity black or intermediate gray scale voltage is simultaneously supplied to i rows of the first block BL1.

In the LCD device according to the illustrated embodiment of the present invention, when the current frame period is not the Nth frame period, the polarity of the data voltage to be supplied to the liquid crystal cells is inverted not only at intervals of one or two rows, but also at intervals of one frame period. In this case, the normal video data voltage is sequentially supplied to all blocks BL1 to BL3 (S61 and S63).

FIGS. 7 to 10 are views for illustrating the effects of preventing DC image sticking and flicker from occurring when scroll data is supplied to the LCD device, in accordance with embodiments of the present invention.

Figure 8:
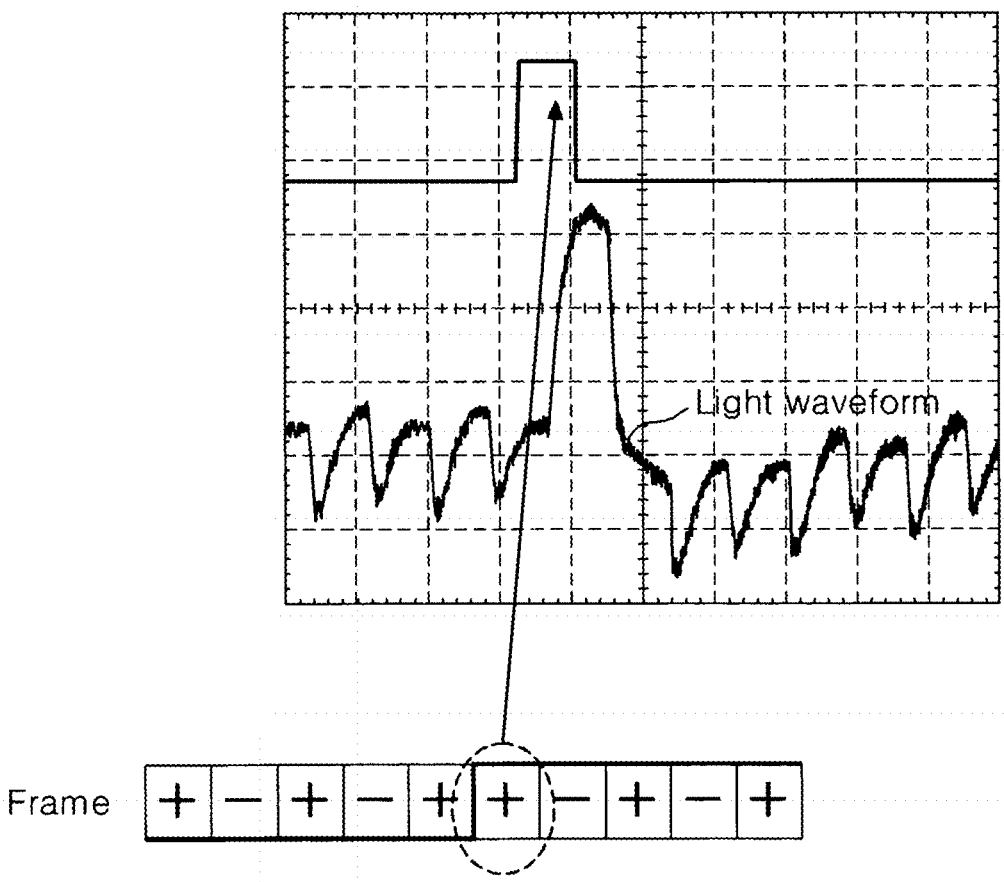
FIG. 8 is a light waveform diagram showing the experimental results showing an abrupt increase in light amount in a second one of two successive frame periods, in which data voltages charged in all liquid crystal cells have the same polarity.
Figure 9:
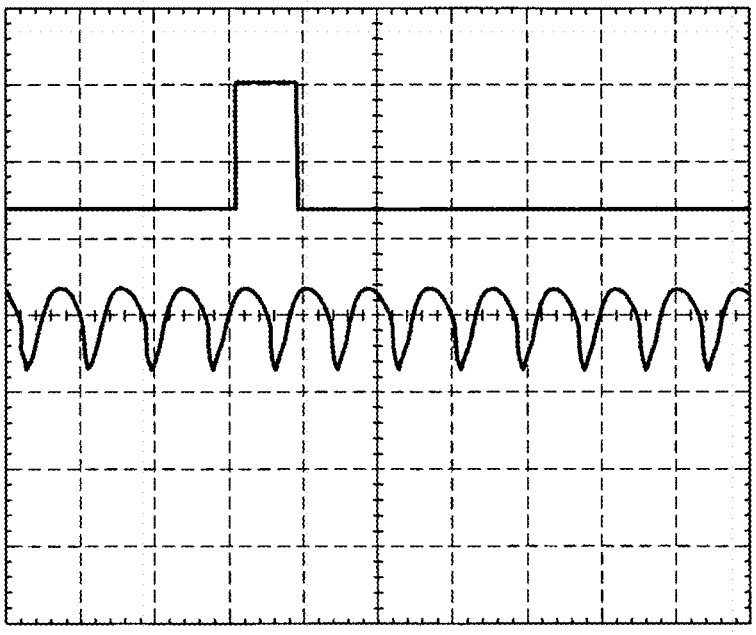
FIG. 9 is a light waveform diagram showing the experimental results obtained in the LCD device according to the illustrated embodiment of the present invention for a plurality of frame periods.

In accordance with the present invention, for scroll data to move a symbol or character at a certain rate, a polarity control signal POL, which has the same polarity pattern in two successive frame periods at intervals of N frame periods, is generated so that the polarity of the data voltage to be supplied to the same liquid crystal cell in two successive frame periods is controlled to be varied in the order of "(−)++"→"(+)−−"→"(−)++"→"(+)−−". Thus, in accordance with the present invention, for scroll data to move a symbol or character at a certain rate, the polarity of the voltage, which is charged in each liquid crystal cell Clc, is periodically inverted, thereby preventing DC image sticking occurring due to an accumulation of voltages having the same polarity. The sign in "( )" means the polarity of the black or intermediate gray scale voltage. In accordance with the polarity of the black or intermediate gray scale voltage, the charge amount of each liquid crystal cell is reduced, so that it is possible to prevent an overcharging phenomenon of data voltages having the same polarity in each liquid crystal cell in two successive frame periods. If the opposite-polarity voltage "( )" is not supplied in the Nth frame period, each liquid crystal cell is overcharged in the (N+1)th frame period, as shown in FIG. 8. As a result, an increase in brightness over a desired level occurs, so that flicker may occur at intervals of N frame periods. In accordance with the present invention, the black or intermediate gray scale voltage having a polarity opposite to the normal video data voltage is charged in each liquid crystal cell at intervals of N frame periods, to prevent flicker from occurring in the (N+1)th frame period, as shown in FIG. 9.

Figure 10:
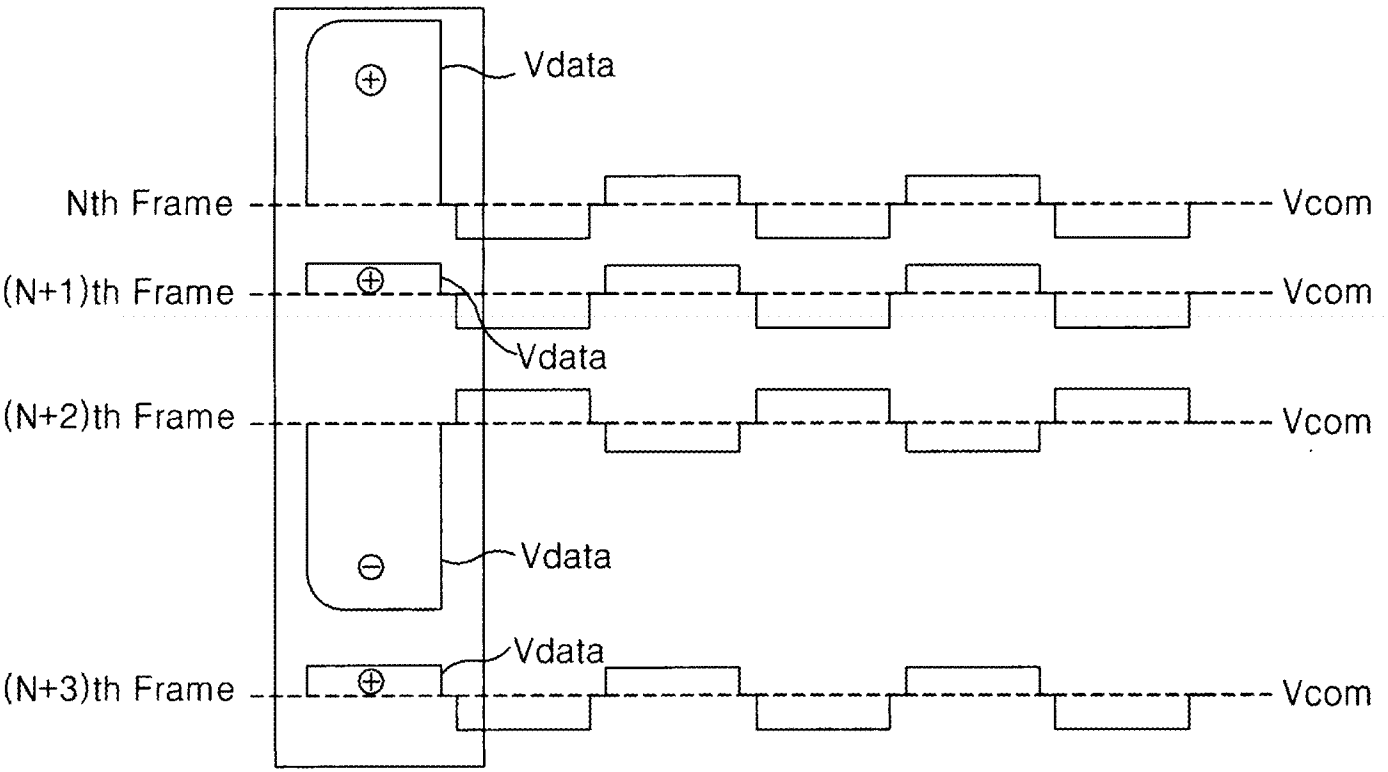
FIG. 10 is a view for explaining the principle of preventing DC image sticking and flicker from occurring in association with interlace data in the LCD device driving method according to the illustrated embodiment of the present invention.

FIG. 10 is a view for explaining effects of preventing DC image sticking and flicker from occurring when interlace data is supplied to the LCD device, in accordance with the above-described embodiments of the present invention.

Referring to FIG. 10, when interlace data is supplied to the liquid crystal cell Clc, high data voltages are supplied to the liquid crystal cell Clc only in the Nth frame period and (N+2)th frame period, respectively, whereas a black voltage or a mean voltage, which is lower than the high data voltages, is supplied to the liquid crystal cell Clc in the (N+1)th frame period and (N+3)th frame period. As a result, the positive data voltage supplied in the Nth frame period and the negative data voltage supplied in the (N+2)th frame period are neutralized, so that there is no polarity-biased voltage accumulated in the liquid crystal cell Clc. Accordingly, no DC image sticking or flicker occurs in the LCD device when interlace data is supplied, in accordance with the embodiment of the present invention.

Figure 11:
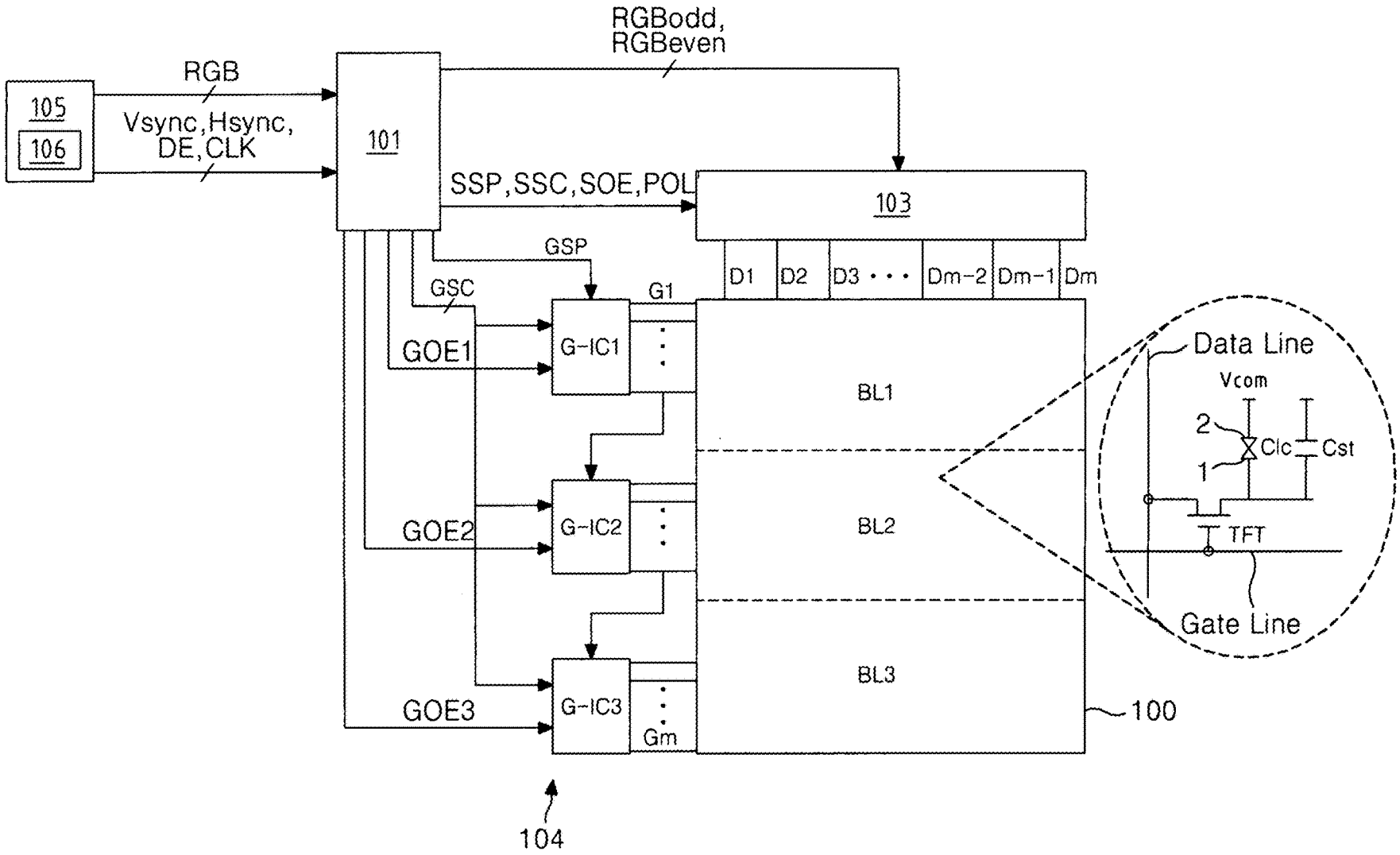
FIG. 11 is a block diagram illustrating an LCD device according to a first embodiment of the present invention.
Figure 12:
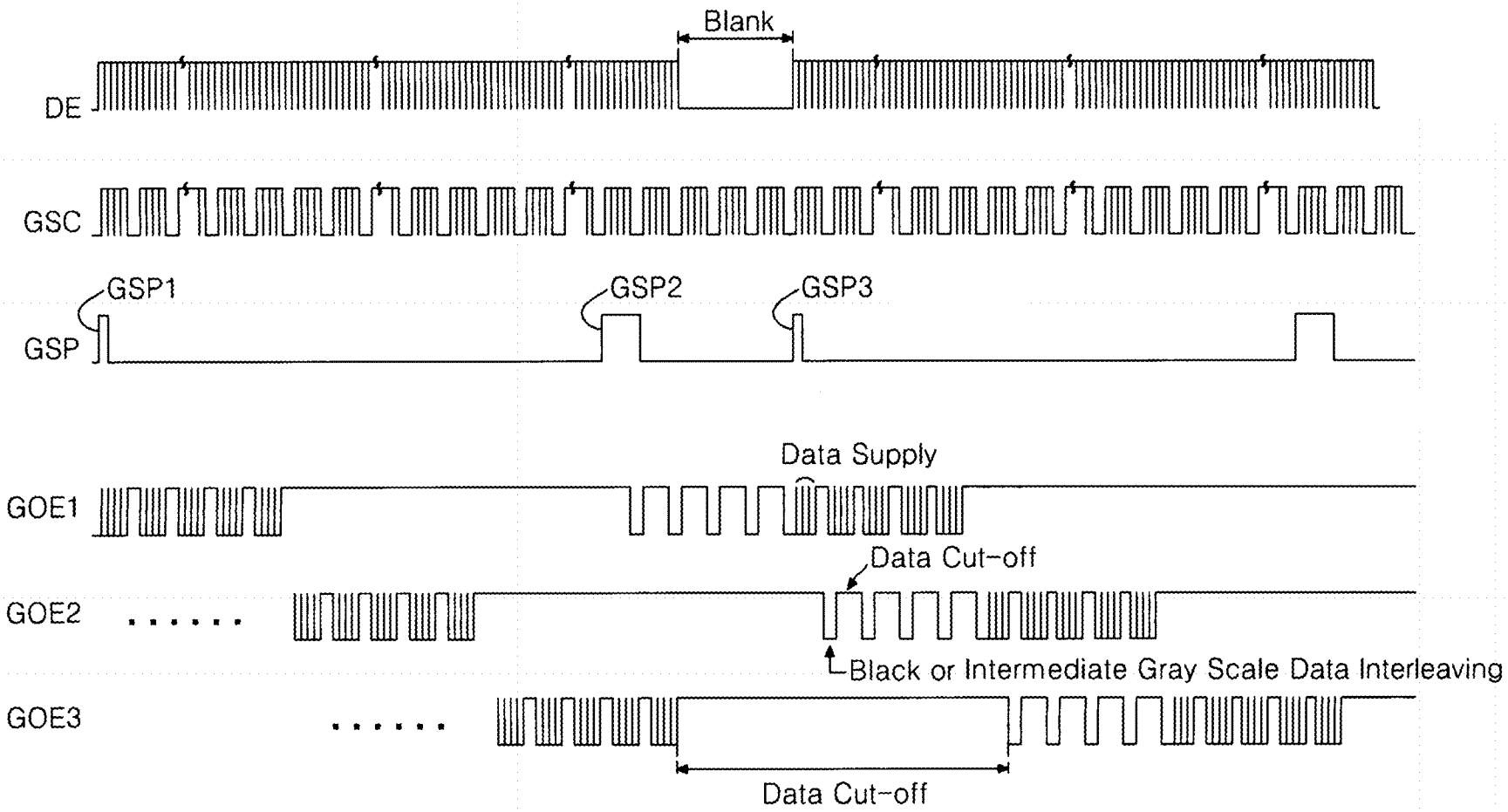
FIG. 12 is a waveform diagram depicting gate timing signals to control a gate driving circuit included in the LCD device shown in FIG. 11 in a specific period.

FIG. 11 illustrates an LCD device according to a first embodiment of the present invention that has a circuit configuration for driving a display screen in a divided manner for 3 blocks. FIG. 12 illustrates waveforms of output signals from a timing controller shown in FIG. 11.

Referring to FIGS. 11 and 12, the LCD device according to the first embodiment of the present invention includes an LCD panel 100, a timing controller 101, a data driving circuit 103, and a gate driving circuit 104.

The LCD panel 100 includes two glass substrates, between which liquid crystal molecules are sealed. The LCD panel 100 also includes m×n liquid crystal cells Clc arranged in a matrix form defined by a crossings of m data lines D1 to Dm with n gate lines G1 to Gn.

Formed on a lower one of the glass substrates of the LCD panel 100 are the data lines D1 to Dm, the gate lines G1 to Gn, thin film transistors (TFTs), pixel electrodes 1 of respective liquid crystal cells Clc coupled to the TFTs, and storage capacitors Cst. A black matrix, color filters, and common electrodes 2 are formed on the upper glass substrate. In a vertical electric field driving system such as a twisted nematic (TN) mode or a vertical alignment (VA) mode, the common electrodes 2 are formed on the upper glass substrate, as described above. On the other hand, in a horizontal electric field driving system such as an in-plane switching (IPS) mode or a fringe field switching (FFS) mode, the common electrodes 2 are formed on the lower glass substrate, together with the pixel electrodes 1. Polarizing plates having optical axes orthogonal to each other are attached to the upper and lower glass substrates, respectively. An alignment film is formed at an interface between each polarizing plate and the liquid crystals, to set a pre-tilt angle of the liquid crystals.

The timing controller 101 receives reference timing signals Vsync, Hsync, DE, and CLK, and generates timing control signals to control the operation timings of the data driving circuit 103 and gate driving circuit 104, based on the received timing signals. The timing control signals include gate timing control signals such as a gate start pulse GSP, a gate shift clock signal GSC, and a gate output enable signal GOE. The timing control signals also include data timing control signals such as a source start pulse SSP, a source sampling clock SSC, a source output enable signal SOE, and a polarity control signal POL.

The gate start pulse GSP is a timing control signal indicating a first scan pulse to be supplied to a start horizontal line, from which a scanning operation starts in one vertical period for displaying one frame, namely, a first gate line. The gate start pulse GSP includes a first gate start pulse GSP1 having a wide pulse width to sequentially select i rows, to which a video data voltage will be supplied, and a second gate start pulse GSP2 having a narrow pulse width to select "i+1" rows, to which a black or intermediate gray scale voltage having a polarity opposite to the video data voltage will be supplied. The gate shift clock signal GSC is a timing control signal, which is input to shift registers included in the gate driving circuit 104, to sequentially shift the gate start pulse GSP. The gate output enable signal GOE is a timing signal enabling an output from the associated G-IC of the gate driving circuit 104. Between successive pulses of the gate output enable signal GOE, a scan pulse is output through an output channel of the associated G-IC. No scan pulse is output from the G-IC in a pulse period of the gate output enable signal GOE. The gate output enable signal GOE is supplied to each G-IC, in order to independently control the supply of scan pulses for individual blocks BL1 to BL3. Accordingly, where the display screen is driven in a divided manner for driving three blocks BL1 to BL3, the gate output enable signal GOE includes a first gate output enable signal GOE1 for controlling an output from a first G-IC G-IC1 to supply a scan signal to the first block BL1, a second gate output enable signal GOE2 for controlling an output from a second G-IC G-IC2 to supply a scan signal to the second block BL2, and a third gate output enable signal GOE3 for controlling an output from a third G-IC G-IC3 to supply a scan signal to the third block BL3.

The source start pulse SSP indicates a start pixel on one horizontal line to display data. The source sampling clock SSC enables a data latch operation of the data driving circuit 103 based on a rising or falling edge. The source output enable signal SOE enables an output from the data driving circuit 103. The polarity control signal POL indicates the polarities of the video data voltage, black voltage, and intermediate gray scale voltage to be supplied to the liquid crystal cells Clc of the LCD panel 100.

In the Nth frame period, the above-described gate/data timing signals should have a frequency enabling the sequential supply of the video data voltage to i rows in "i+1" horizontal periods, while enabling the simultaneous supply of the opposite-polarity black or intermediate gray scale voltage to i rows. On the other hand, in frame periods other than the Nth frame period, the gate/data timing signals should have a lower frequency that does not provide for the supply of the opposite-polarity black or intermediate gray scale voltage. Therefore, when it is assumed that the frequency of the timing signals generated in frame periods other than the Nth frame period is "1", the timing signals generated in the Nth frame period should have a frequency multiplied by a multiple of (i+1)/i. For example, when it is desired to sequentially select 4 rows from a specific block, for the supply of the video data voltage, and to simultaneously select 4 rows from another block, for the supply of the opposite-polarity black or intermediate gray scale voltage, the frequency of the timing signals in the Nth frame period should be faster than the frequency of normal timing signals generated in other frame periods other than the Nth frame period, by 5/4-fold. In order to sequentially select 2 rows from a specific block, for the supply of the video data voltage, and to simultaneously select 2 rows from another block, for the supply of the opposite-polarity black or intermediate gray scale voltage, the frequency of the timing signals in the Nth frame period should be faster than the frequency of normal timing signals generated in other frame periods other than the Nth frame period, by 3/2-fold.

The timing controller 101 separates input digital video data RGB into odd pixel data RGBodd and even pixel data RGBeven, thereby reducing the transfer frequency for the data to be supplied to the data driving circuit 103 to ½.

The data driving circuit 103 operates faster in response to fast-frequency data timing control signals in the Nth frame period, in synchronism with a scan pulse, as compared to frame periods other than the Nth frame period. The data driving circuit 103 latches the digital video data RGBodd and RGBeven input from the logic circuit 102 under the control of the timing controller 101. The data driving circuit 103 also converts the latched digital video data RGBodd and RGBeven into positive/negative analog gamma compensating voltages in accordance with the polarity control signal POL, and thus generates positive/negative analog data voltages. The data voltages from the data driving circuit 103 are supplied to the data lines D1 to Dm.

The gate driving circuit 104 includes a plurality of G-ICs each including a shift register, a level shifter for converting an output signal of the shift register into a signal having a swing width suitable for the driving of the TFTs of the associated liquid crystal cells, and an output buffer coupled between the level shifter and an associated one of the gate lines G1 to Gn. Where the display screen is driven in a divided manner for three blocks BL1 to BL3, the gate driving circuit 104 includes three G-ICs G-C1 to G-IC3. The gate driving circuit 104 supplies a scan pulse to the gate lines G1 to Gn in response to the gate timing control signals.

The LCD device according to the illustrated embodiment of the present invention further includes a system 105 for supplying the digital video data RGB and timing signals Vsync, Hsync, DE, and CLK to the timing controller 101.

The system 105 includes a broadcast signal receiver, an external appliance interface circuit, a graphic processing circuit, a line memory 106, etc. The system 105 extracts video data from a broadcast signal received by the broadcast signal receiver or an image source input from an external appliance through the external appliance interface circuit, converts the extracted video data into digital video data, and supplies the digital video data to the timing controller 101. An interlaced broadcast signal, which is received by the system 105, is stored in the line memory 106. The video data of the interlaced broadcast signal exists only on odd lines in odd frame periods, and exists only on even lines in even frame periods. Accordingly, when the system 105 receives an interlaced broadcast signal, it generates even line data for odd frame periods and odd line data for even frame periods, using a mean value of effective data stored in the line memory 106 or a black data value. The system 105 supplies reference timing signals Vsync, Hsync, DE, and CLK to the timing controller 101, together with the digital video data. The reference timing signals include a vertical synchronizing signal Vsync indicating one frame period, a horizontal synchronizing signal Hsync indicating one horizontal period corresponding to one row, a data enable signal DE indicating a period in which effective data of all rows included in the vertical resolution of the display screen is present, and a clock signal CLK. The system 105 also supplies electric power to a DC-DC converter functioning to generate drive voltages for the timing controller 101, data driving circuit 103, gate driving circuit 104, and LCD display panel 100. The system 105 also supplies electric power to an inverter for turning on a light source included in a backlight unit.

Figure 13:
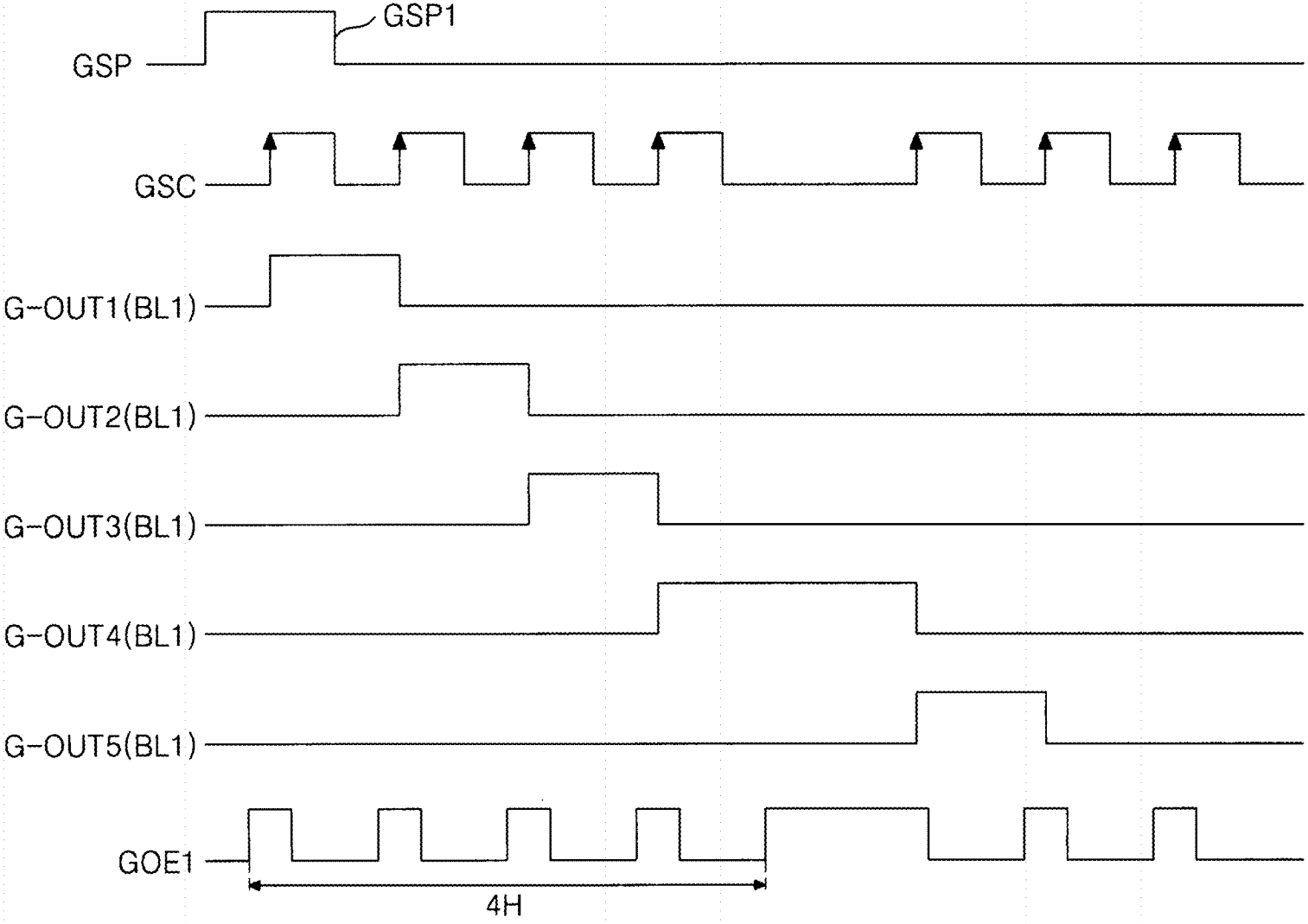
FIG. 13 is a waveform diagram depicting gate timing signals to supply a video data voltage to a first block in a specific period.

FIG. 13 illustrates gate timing signals for supplying a video data voltage to the first block BL1 in the Nth frame period. The gate timing signals correspond to an example in which, after a sequential generation of 4 scan pulses, no scan pulse is output for one horizontal period in which the opposite-polarity black or intermediate gray scale voltage is supplied to 4 rows of another block.

Referring to FIG. 13, in response to the first gate start pulse GSP1, which has a pulse width of about one horizontal period 1H, the first G-IC G-IC1 shifts the first gate start pulse GSP1 in synchronism with a rising edge of the gate shift clock GSC, which is generated at intervals of one horizontal period, and outputs the shifted pulse. Thus, the first G-IC G-IC1 sequentially supplies to the gate lines of the first block BL1, scan pulses G-OUT1(BL1) to G-OUT4 (BL1) each having a pulse width of about one horizontal period. 4 gate shift clocks GSC are generated in 4 horizontal periods, and no gate shift clock GSC is generated in a subsequent horizontal period in which the opposite-polarity black or intermediate gray scale voltage is supplied to another block. The pulses of the first gate output enable signal GOE1 are generated in synchronism with the rising edges of the 4 gate shift clocks GSC, respectively, and then the first gate output enable signal GOE1 is maintained at a high logic level for about one horizontal period, to cut off an output from the first G-IC G-IC1. Accordingly, 4 rows of the first block BL1 are sequentially selected by the scan pulses G-OUT1(BL1) to G-OUT4(BL1), to enable the video data voltage to be supplied to the 4 rows. Thereafter, the first block BL1 is maintained at the level of the charged data voltage during a period corresponding to a fifth row because there is no output from the first G-IC G-IC1 for this period.

Figure 14:
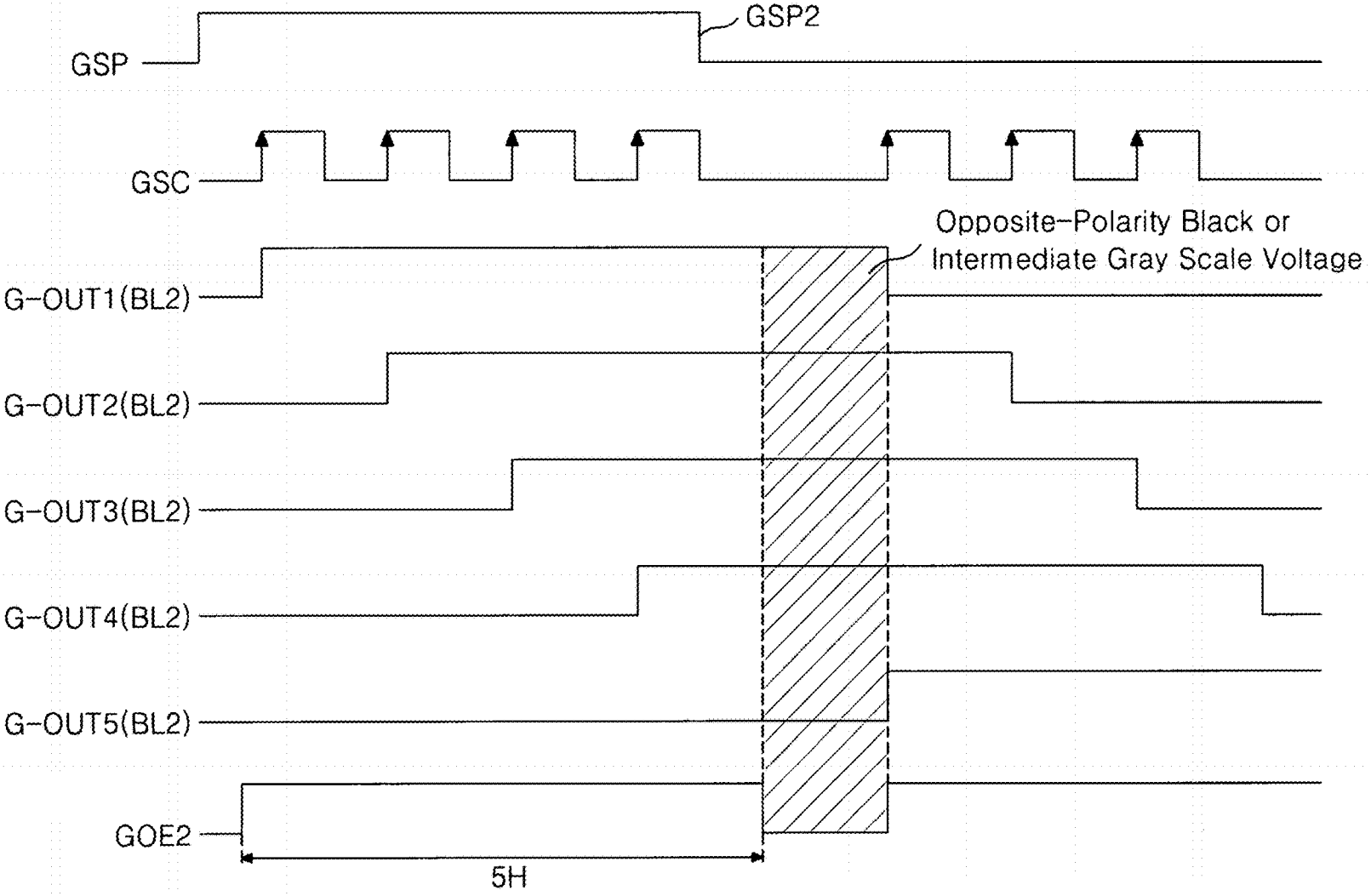
FIG. 14 is a waveform diagram depicting gate timing signals to supply an opposite-polarity black or intermediate gray scale voltage to a second block in a specific period.

FIG. 14 illustrates gate timing signals for supplying the opposite-polarity black or intermediate gray scale voltage to the second block BL2 in the Nth frame period. The gate timing signals correspond to an example in which scan pulses are overlapped to enable the simultaneous supply of the opposite-polarity black or intermediate gray scale voltage to 4 rows in one horizontal period.

Referring to FIG. 14, in response to the second gate start pulse GSP2, which has a pulse width of about 4 horizontal periods 4H, the second G-IC G-IC2 shifts the second gate start pulse GSP2 in synchronism with a rising edge of the gate shift clock GSC that is generated at intervals of one horizontal period, and outputs the shifted pulse. Thus, the second G-IC G-IC2 sequentially supplies, to the gate lines of the second block BL2, scan pulses G-OUT1(BL2) to G-OUT4(BL2). Four gate shift clocks GSC are generated in 4 horizontal periods, and no gate shift clock GSC is generated in a subsequent horizontal period in which the supply of data to other blocks is cut off. For the 4 horizontal periods, in which 4 gate shift clocks GSC are generated, the second gate output enable signal GOE2 is maintained at a high logic value, thereby cutting off an output from the second G-IC GIC2. In the subsequent one horizontal period, in which the supply of data to other blocks is cut off, the second gate output enable signal GOE2 has a low logic value, thereby enabling an output from the second G-IC G-IC2. Scan pulses G-OUT1(BL2) to G-OUT5(BL2) are output from the second G-IC G-IC2 in accordance with the pulse width of the second gate start pulse GSP2 and the gate shift clock GSC, such that each of the scan pulses G-OUT1(BL2) to G-OUT5 (BL2) has a pulse width of 5 horizontal periods. Accordingly, 4 rows of the second block BL2 are simultaneously selected in one horizontal period in which the gate shift clock GSC is not generated. In this period, the data driving circuit 103 supplies the opposite-polarity black or intermediate gray scale voltage to the data lines.

Thus, as can be seen from FIGS. 5, 12, and 13, the LCD device according to the illustrated embodiment of the present invention accelerates the frequency of the timing signals in the Nth frame period, to sequentially supply the video data voltage to i rows of a specific block for i horizontal periods, and then to supply the black or intermediate gray scale voltage to i rows of another block for one horizontal period.

Figure 15:
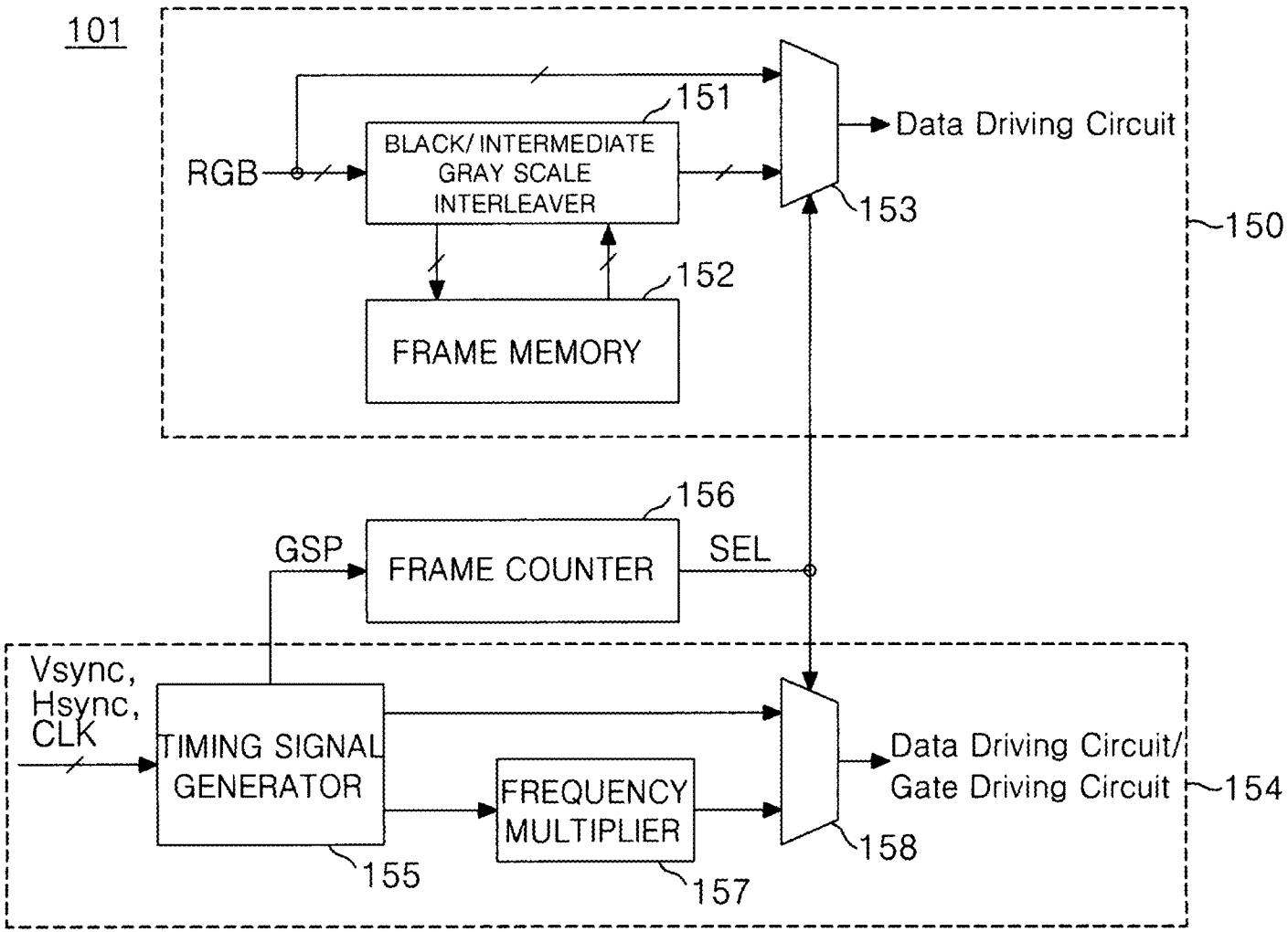
FIG. 15 is a circuit diagram illustrating detailed configurations of a data controller and a timing signal controller included in a timing controller.

FIG. 15 is a circuit diagram illustrating details of a data controller and a timing signal controller included in the timing controller 101.

Referring to FIG. 15, the timing controller 101 includes a frame counter 156, a data controller 150, and a timing signal controller 154.

The frame counter 156 counts a desired one of the reference timing signal or the gate start pulse, to determine the number of frames. The frame counter 156 supplies a select signal SEL indicating an Nth frame period to output control terminals of the data controller 150 and timing signal controller 154, to control outputs from the data controller 150 and timing signal controller 154.

In each Nth frame period, the data controller 150 periodically interleaves digital black gray scale data or intermediate gray scale data into input digital video data RGB, separates the digital video data into odd data and even data, and supplies the separated data to the data driving circuit 103. In frame periods other than the Nth frame period, the data controller 150 separates the input digital video data RGB into odd data and even data without interleaving of other data (that is without the interleaving of the digital black or intermediate gray scale data), and supplies the separated data to the data driving circuit 103. For performing these functions, the data controller 150 includes a frame memory 152, a black/intermediate gray scale interleaver 151, and a multiplexer 153. The frame memory 152 stores the input digital video data RGB. The black/intermediate gray scale interleaver 151 reads out the input digital video data RGB from the frame memory 152, and periodically interleaves digital black gray scale data or intermediate gray scale data into the read-out digital video data RGB. The multiplexer 153 outputs data received from the black/intermediate gray scale interleaver 151, in response to the select signal SEL supplied from the frame counter 156 in the Nth frame period. In frame periods other than the Nth frame period, the multiplexer 153 outputs the input digital video data RGB, into which separate black or intermediate gray scale data has not been interleaved. The data output from the multiplexer 153 is transferred to the data driving circuit via 6 data transfer buses after being separated into odd data and even data.

The timing signal controller 154 generates timing signals to control the operation timings of the data driving circuit 103 and gate driving circuit 104. The timing signal controller 154 also accelerates the frequencies of the timing signals in the Nth frame period. For performing these functions, the timing signal controller 154 includes a timing signal generator 155, a frequency multiplier 157, and a multiplexer 158. The timing signal generator 155 generates gate timing signals and data timing signals such that each of the timing signals has a normal driving frequency, using input reference timing signals. The frequency multiplier 157 multiplies the frequency of each timing signal output from the timing signal generator 155 by a multiple of (i+1)/i with reference to an internal clock having a fast frequency. In response to the select signal SEL from the frame counter 156, the multiplexer 158 supplies the frequency-accelerated timing signals from the frequency multiplier 157 to the data driving circuit 103 and gate driving circuit 104 in the Nth frame period. On the other hand, in frame periods other than the Nth frame period, the multiplexer 158 supplies the normal-frequency timing signals from the timing signal generator 155 to the data driving circuit 103 and gate driving circuit 104.

As apparent from the above description, in the LCD device and driving method thereof according to any one of the above-described embodiments of the present invention, the polarity of the data voltage supplied to liquid crystal cells is inverted at intervals of one frame period, and is periodically controlled such that the data voltages respectively supplied in two successive frame periods have the same polarity. Accordingly, it is possible to prevent DC image sticking. Also, an opposite-polarity black or intermediate gray scale voltage is temporarily charged in each liquid crystal cell prior to a second one of the two successive frame periods, to prevent overcharging of the liquid crystal cell. Accordingly, it is possible to prevent flicker. Thus, in the LCD device and driving method thereof according to any one of the above-described embodiments of the present invention, it is possible to display a high-quality image without DC image sticking and flicker, even when data having a possibility to cause DC image sticking is input.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device comprising:

a liquid crystal display panel formed with a plurality of data lines and a plurality of gate rows, the liquid crystal display panel having a plurality of liquid crystal cells;

a data controller for interleaving one of black data and intermediate gray data that is between the black data and white data with first input digital video data in a period preceding a second one of two successive frame periods of a plurality of frame periods;

a timing signal controller generating a data timing signal and a gate timing signal, and accelerating a frequency of the data timing signal and a frequency of the gate timing signal in the period preceding the second one of the two successive frame periods by a multiple of (i+1)/i, where i is a portion of gate rows of the liquid crystal display panel that is enabled;

a data driving circuit converting the first input digital video data interleaved with the black data or the intermediate gray data into first analog data voltages and one of black data voltages and intermediate gray data voltages in response to the accelerated frequency of the data timing signal, and supplying the first analog data voltages to the plurality of data lines in the period preceding the second one of the two successive frame periods, and converting second input digital video data not interleaved with the black data or the intermediate gray data into second analog data voltages in response to the frequency of the data timing signal, which is not accelerated, and supplying the second analog data voltages to the plurality of data lines in a part of the plurality of frame periods that excludes the period preceding the second one of the two successive frame periods; and a gate driving circuit including a plurality of gate integrated circuits operating independently, the plurality of gate integrated circuits supplying a plurality of scan pulses to the plurality of gate rows, one gate integrated circuit supplying scan pulses to i number of gate rows to which first analog data voltages are supplied to the plurality of liquid crystal cells and another gate integrated circuit supplying scan pulses to another i number of gate rows to which one of black data voltages and intermediate gray data voltages are supplied to the plurality of liquid crystal cells in the period preceding the second one of the two successive frame periods in response to the accelerated frequency of the gate timing signal, and the plurality of gate integrated circuits supplying the plurality of scan pulses to the plurality of gate rows in the part of the plurality of frame periods that excludes the period preceding the second one of the two successive frame periods in response to the frequency of the gate timing signal, which is not accelerated, wherein the second analog data voltages are inverted in polarity in every frame of the part of the plurality of frame periods that excludes the period preceding the second one of the two successive frame periods.

2. The liquid crystal display device according to claim 1, wherein the accelerated frequency of the gate timing signal further comprises a gate start pulse instructing output start points of the plurality of gate integrated circuits, the gate start pulse being generated to have one horizontal period pulse width of a plurality of horizontal period pulse widths in the period preceding the second one of the two successive frame periods.

3. The liquid crystal display device according to claim 2, wherein the gate timing signal comprises a plurality of gate output enable signals, and the gate output enable signals are generated to periodically have the one horizontal period pulse width of the plurality of horizontal period pulse widths, and are supplied to the plurality of gate integrated circuits after being sequentially shifted, respectively.

* * * * *